US008079626B2

(12) United States Patent
Estes

(10) Patent No.: US 8,079,626 B2
(45) Date of Patent: Dec. 20, 2011

(54) ROLL-OFF CONTAINER WITH ADJUSTABLE ATTACHMENT APPARATUS

(76) Inventor: Robert L. Estes, Uniontown, OH (US)

( * ) Notice: Subject to any disclaimer, the term of this patent is extended or adjusted under 35 U.S.C. 154(b) by 906 days.

(21) Appl. No.: 12/005,524

(22) Filed: Dec. 27, 2007

(65) Prior Publication Data

US 2009/0167039 A1 Jul. 2, 2009

(51) Int. Cl.
*B65D 90/00* (2006.01)

(52) U.S. Cl. ..... 294/68.1; 220/1.5; 414/498

(58) Field of Classification Search ..... 294/68.1; 220/1.5; 414/491, 498, 546, 547, 555; 108/53.1, 108/55.1; 280/490.1
See application file for complete search history.

(56) References Cited

U.S. PATENT DOCUMENTS

| | | | |
|---|---|---|---|
| 2,812,013 | A | 11/1957 | Kreciglowa |
| 3,400,949 | A | 9/1968 | Kendall |
| 3,591,121 | A | 7/1971 | Parris |
| 3,692,330 | A | 9/1972 | Kendall |
| 3,841,505 | A | 10/1974 | Kent |
| 3,874,497 | A | 4/1975 | Carlson |
| 3,897,882 | A | 8/1975 | Budoff |
| 3,984,013 | A | 10/1976 | Wirz |
| 4,047,755 | A | 9/1977 | McDonald et al. |
| 4,165,007 | A | 8/1979 | Brown |
| 4,790,601 | A | 12/1988 | Burleigh et al. |
| 4,813,739 | A | 3/1989 | Miller |
| 4,844,336 | A | 7/1989 | Huber et al. |
| 4,848,619 | A | 7/1989 | Corompt |
| 4,869,344 | A | 9/1989 | Peterson |
| 4,911,318 | A | 3/1990 | Bishop |
| 4,964,349 | A | 10/1990 | Bishop |
| 5,169,194 | A | 12/1992 | Yamashita et al. |
| 5,240,320 | A | 8/1993 | Yerman |
| 5,257,844 | A | 11/1993 | Patouillard et al. |
| 5,490,753 | A | 2/1996 | Green |
| 6,059,512 | A | 5/2000 | Kielinski |
| 6,125,720 | A | 10/2000 | Gohman |
| 6,186,731 | B1 | 2/2001 | Vickers et al. |
| 6,296,132 | B1 | 10/2001 | Pickler |
| 6,364,153 | B1 | 4/2002 | Petzitillo, Jr. et al. |
| 6,398,302 | B1 | 6/2002 | Freedman et al. |
| 7,306,273 | B2 | 12/2007 | Estes |
| 2005/0052042 | A1 | 3/2005 | Estes |

FOREIGN PATENT DOCUMENTS

| | | |
|---|---|---|
| JP | 52-066226 | 6/1977 |
| JP | 58-097534 | 6/1983 |
| JP | 58-141943 | 8/1983 |

*Primary Examiner* — Paul T Chin
(74) *Attorney, Agent, or Firm* — Hudak, Shunk & Farine Co. LPA

(57) ABSTRACT

An adjustable attachment apparatus for a container, in particular, a roll-on, roll-off container, for use with a truck equipped to transport the carrier, such as a hoist truck. The container attachment apparatus includes a connector member, more specifically a hook receiving member which is vertically adjustable in apertures of a guide member to a plurality of different heights in relation to a ground surface in order to accommodate trucks having container retrieving hoist mechanisms with a hook or other element of differing minimum heights which manipulates the container through the connector member. In one embodiment, the guide member includes a rail having a slotted track and a connector member is connected to the guide member by a locking mechanism.

11 Claims, 3 Drawing Sheets

ROLL-OFF CONTAINER WITH ADJUSTABLE ATTACHMENT APPARATUS

FIELD OF THE INVENTION

The present invention relates to an adjustable attachment apparatus for a container, in particular, a roll-on, roll-off container, for use with a truck equipped to transport the carrier, such as a hoist truck. The container attachment apparatus comprises a connector member, more specifically a hook-receiving or hitch member which is vertically adjustable to a plurality of different heights in relation to a ground surface in order to accommodate various trucks having container retrieving hoist mechanisms with a hook or other element of differing minimum heights which manipulate the container through the connector member.

BACKGROUND OF THE INVENTION

Roll-on, roll-off and other containers of many sizes and types are known and are often used in the collection and transportation of numerous materials including waste materials; residential, commercial and industrial refuse or debris; bulk materials; finished products; parts; or components. Generally, a container is transported by a truck to the site where it is to be filled. The container is unloaded by the truck in some cases by tilting the bed and setting the container on the ground with the aid of a container retrieving hoist mechanism. The container is then filled while sitting on the ground, floor, or other surface before being reloaded onto a truck and transported elsewhere to be emptied or the like.

Some prior art containers have been designed with standardized fittings that are specific to facilitate transport by a certain size and/or type of transport means, i.e., truck. The container fittings are permanently positioned to be engaged by the hook or other element of a container retrieving hoist mechanism at a defined height. It is a problem that only a specific truck having a container retrieving mechanism with a minimum hook or other element height can matingly engage or retrieve a container with a specific hook-receiving support or connector member height.

U.S. Pat. No. 3,841,505 relates to a self-packing and ejecting roll off container has a top door and two side doors slightly spaced from a first closed end. A concave packing and ejecting blade having a replaceable edge with a downward extending, friction reducing strip is mounted on a frame which is supported on guides spaced upward from the bottom of the sidewalls. The frame and curved blade are homed at the first closed end with the blade near the door openings. The frame and blade are moved by a multiple stage hydraulic cylinder. The container is completed by a power drive tailgate which closes the container and by a seal which extends inward from the tailgate against the open end to tightly seal the container. The base of the container has hooks at opposite longitudinal ends so that the container may be rolled on and rolled off trucks at either end.

U.S. Pat. No. 3,897,882 relates to a reversible roll-off container for use with a truck chassis. The truck chassis has a rearwardly directed frame and means for hoisting and positioning a container thereon. The container has an improved frame engaging means thereon providing for bidirectional loading of the container and automatic securing or holding of the container on the truck during transport or unloading of the container contents.

U.S. Pat. No. 4,848,619 relates to a removable support with a transverse hooking bar for equipping a front panel of a container, having a front panel and an upper panel, to receive a hook of a swinging cross piece bracket, adapted to fit a transportation and handling vehicle, wherein a transverse hooking bar of the movable support receives a handling hook which is connected to the vehicle. The hooking bar is thereby disposed on the front panel, connected to the removable support. The container is locked into place by an eclipsible lock, but at the same time the removable support can be unlocked, allowing access to the front panel of the container. The removable support can pivot about an axis to a horizontal position on the upper panel of the container where it may be locked into place. The support is vertically moveable on the front panel and may be secured at the top or bottom of the panel by means of the eclipsible lock. A swinging door located on the front panel is made accessible by use of the removable support.

U.S. Pat. No. 5,169,194 relates to a container which has a support member which ascends and descends and is provided at back of a container body, a top connecting member which is fixed at front of the container body and can couple and decouple with a carrier, a bottom connecting member which is provided at the front of the container body so as to be able to move and which couples and decouples with the carrier, and transmitting members which transmit the movement of the bottom connecting member to the support member and raise and lower the support member. When this container is loaded on the carrier, it is reportedly possible to synchronize the front and back of the container body so that the container remains level by raising the front of the container by lifting the top connecting member at the front of the container body by means of a member of the carrier, and holding the bottom connecting member at the front of the container fixed with respect to the ground, transferring the motion of the bottom connecting member relative to the container body to the support member at the back of the container by means of the transmitting members, and extending the support member at the back of the container down to raise the back of the container.

U.S. Patent Publication No. 2005/0052042 and U.S. Pat. No. 7,306,273 relate to an adjustable attachment apparatus for a container, in particular, a roll-on, roll-off container, for use with a truck equipped to transport the carrier, such as a hoist truck. The container attachment apparatus includes a connector member, more specifically a hook-receiving member which is vertically adjustable in a guide member to a plurality of different heights in relation to a ground surface in order to accommodate trucks having container retrieving hoist mechanisms with a hook or other element of differing minimum heights which manipulates the container through the connector member. In one embodiment, the guide member includes a rail having a slotted track.

SUMMARY OF THE INVENTION

The present invention provides an attachment apparatus for a container having a connector member fixable at a plurality of different vertical positions with respect to a guide member and can be connected to or retrieved by multiple trucks or other means having container retrieving hoist mechanisms with different hook or other attachment element minimum heights. With the container of the present invention including the apparatus, substantially any container-transporting truck equipped to haul roll-on, roll-off containers can be used to transport the same.

The attachment apparatus is connected to a container wall, preferably a vertical end wall or face wall, panel or section. The apparatus includes at least one stationary guide member which is generally arranged in a vertical direction on the container, preferably centrally located between the ends of the front wall of the container. A connector member having a crossbar, pin or other hookable element, is operatively connected to the guide member and is fixable, in one embodiment, at a plurality of vertical heights in relation to the guide member and thus also with respect to the rest of the container, as well as a ground surface. In a further embodiment, a connector member having a crossbar, pin or other hookable element, is operatively connected to the guide member and is fixable at a plurality of vertical heights. The apparatus further comprises a fastening mechanism capable of fixedly positioning, i.e., locking, the connector member in relation to the guide member in a plurality of fastening positions.

In one preferred embodiment, the connector member is situated in a channel created by a guide member and is adjustably securable in a plurality of vertical positions within the channel. The connector member preferably includes a support, pin, or hooking bar which receives a hook or other implement of the truck container receiving hoist mechanism.

In a further embodiment, the container attachment apparatus includes guide member side members or rails comprising a slotted track in which the connector member travels and is adjustably securable in a plurality of vertical positions or heights in relation to the guide member, container, or a ground surface. The slotted track is formed in the side rails of the guide member and forms a pathway in which the connector member is moveable in order to be placed at a predetermined height at which a hook or other implement of a hoist truck can be operatively connected thereto to load and transport a container attached to the attachment apparatus.

In yet another embodiment, each guide rail of a guide member includes a plurality of apertures, at a plurality of vertical positions with respect to the container each guide member is attached to, as well as a ground surface. In a preferred embodiment, an aperture in a first guide member is co-aligned with an aperture in a second guide member. A connector member is removably and operatively fastened between the first and second guide member apertures at a predetermined height. In one embodiment, the connector member has an end portion having an attachment member such as a thread, an aperture, a groove, or the like that allows for connection of a securing element such as a nut, pin, or the like in order to secure the connector member to the guide member.

In a further embodiment, the guide member includes a plurality of connector members attached thereto. The connector members are each attached at different heights and can each accept a hook or other implement of a hoist truck. Preferably, each connector member is movable in relation to the guide member and can be moved into a position ready for attachment to the hook or other implement of the hoist truck when desired.

In still a further embodiment, the slotted track of the guide rail is provided with a locking mechanism that locks the connector member in a predetermined position with respect to the guide member. The connector member can be unlocked, moved to a second position and locked into position with a second locking mechanism.

In a preferred embodiment, the locking mechanism includes a pawl operatively connected to the guide member and a ratchet connected to the connector member. Teeth on the ratchet are engaged with the pawl to fix the connector member to the guide member. The pawl is released in order to move or reposition the connector member. The pawl is preferably located along and biased towards the arm slot of the slotted track in order to lock the connector member at substantially the end of the arm slot opposite the open end connected to the height adjustment slot.

In one aspect of the present invention, an attachment apparatus for a container is disclosed, comprising a guide member having at least two guide rails disposed a distance from each other, said guide member having a front edge, and a rear edge adapted to be connected to the container, said container adapted to include an area adapted to hold materials and be transported by a transport vehicle utilizing the attachment apparatus, said slotted track having a height adjustment slot having a slot length and at least two arm slots connected to and extending outwardly a predetermined distance away from the height adjustment slot and away from the rear edge of the guide member, a connector member operatively connected to and movable in the slotted track of each said at least two guide rails, the connector member extending between the at least two guide rails and through the slotted track in the at least two guide rails, the connector member having an end element connected to each end of the connector member at a location outside of the at least two guide rails to prevent selective removal of the connector member from the guide member, wherein each arm slot is connected to the height adjustment slot so that the connector member is movable between the height adjustment slot and each arm slot, wherein each arm slot terminates at an end portion within the guide rail toward a front edge of the guide member, and wherein the connector member is adapted to be engaged by a hook or attachment element of a container retrieving hoist mechanism of the transport vehicle at the end portion of the arm slot located toward the front edge of the guide member and away from the rear edge of the guide member so that the attachment apparatus can be moved, and a locking mechanism capable of fixedly connecting the connector member to one of the arm slots of the guide rail, wherein the locking member has a first portion that is connected to the guide member adjacent one of the arm slots and a second portion capable of operatively connecting the connector member to the first portion.

In another aspect of the present invention, a transportable container having a height adjustable attachment apparatus is disclosed, comprising a container body comprising a base, two side walls, a rear wall, and a front, upright section attached to said base, said container defining a volume adapted to hold materials and be transported by a transport vehicle utilizing the attachment apparatus; the attachment apparatus comprising a guide member having at least two guide rails, said guide member attached to said container front upright section; a connector member operatively connected to and moveable in a slotted track having a comb configuration in each of said guide rails, wherein said slotted track has a height adjustment slot and at least two arm slots located further away from the container front and the base than the height adjustment slot and extending a predetermined distance away from the height adjustment slot toward a front edge of the guide member and away from the container wherein the connector member includes portions which extend through the slotted track in each guide rail and end elements which prevent removal of the connector member from the slotted tracks and wherein each arm slot is connected to the height adjustment slot so that the connector member is movable between the height adjustment slot and each arm slot, wherein the connector member extends between the at least two guide rails, wherein each arm slot terminates in an end portion within the guide rail toward the front edge of the guide rail, and wherein the connector member is adapted to be engaged by a hook or attachment element of a container retrieving hoist mechanism of the transport vehicle at the end portion of the arm slot located toward a front edge of the guide member and away from a rear edge of the guide member so that the attachment apparatus and container connected thereto can be moved; and a locking mechanism capable of fixedly connecting the connector member to one of the arm slots of the guide rail, wherein the locking member has a first portion that is connected to the guide member adjacent one of the arm slots and a second portion capable of operatively connecting the connector member to the first portion.

In yet another aspect of the invention, an attachment apparatus for a container that is adapted to be used to transport the container is disclosed, comprising a stationary guide member having at least two guide rails spaced a distance from each other, wherein the guide member is adapted to be connected to a wall of the container by one or more of a back member separate and distinct from the container wall and a rear edge of each of the at least two guide rails, each guide rail having at least two apertures located at different vertical heights and capable of receiving a crossbar of a connector member, wherein the first aperture of the first guide rail is substantially vertically and horizontally co-aligned with the first aperture of the second guide rail, wherein the second aperture of the first guide rail is substantially vertically and horizontally co-aligned with the second aperture of the second guide rail; and the connector member crossbar extending completely through one set of the co-aligned apertures of the first guide rail and the second guide rail, and wherein the crossbar extends between the guide rails and is adapted to be engaged by a hook or attachment element of a container retrieving hoist mechanism of a transport vehicle so that the attachment apparatus can be moved, wherein the connector member is fixedly connectable to the guide member by a securing mechanism connected to the connector member through one or more of a connection to the connector member (a) outside the guide rails and (b) in between the guide rails.

In still a further aspect of the present invention, a transportable container having a height adjustable attachment apparatus is disclosed, comprising a container body comprising a base, two side walls, a rear wall, and a front, upright section attached to said base, said container defining a volume adapted to hold materials and be transported by a transport vehicle utilizing the attachment apparatus; the attachment apparatus comprising a stationary guide member having at least two guide rails spaced a distance from each other, wherein the guide member is connected to a wall of the container by one or more of a back member separate and distinct from the container wall and a rear edge of the at least two guide rails, each guide rail having at least two apertures located at different vertical heights and capable of receiving a crossbar of a connector member, wherein the first aperture of the first guide rail is substantially vertically and horizontally co-aligned with the first aperture of the second guide rail, wherein the second aperture of the first guide rail is substantially vertically and horizontally co-aligned with the second aperture of the second guide rail; and the connector member crossbar extending completely through one set of the co-aligned apertures of the first guide rail and the second guide rail, and wherein a crossbar extends between the guide rails and is adapted to be engaged by a hook or attachment element of a container retrieving hoist mechanism of a transport vehicle so that the attachment apparatus can be moved, wherein the connector member is fixedly connectable to the guide member by a securing mechanism connected to the connector member through one or more of a connection to the connector member outside the rail or inside the guide rail.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
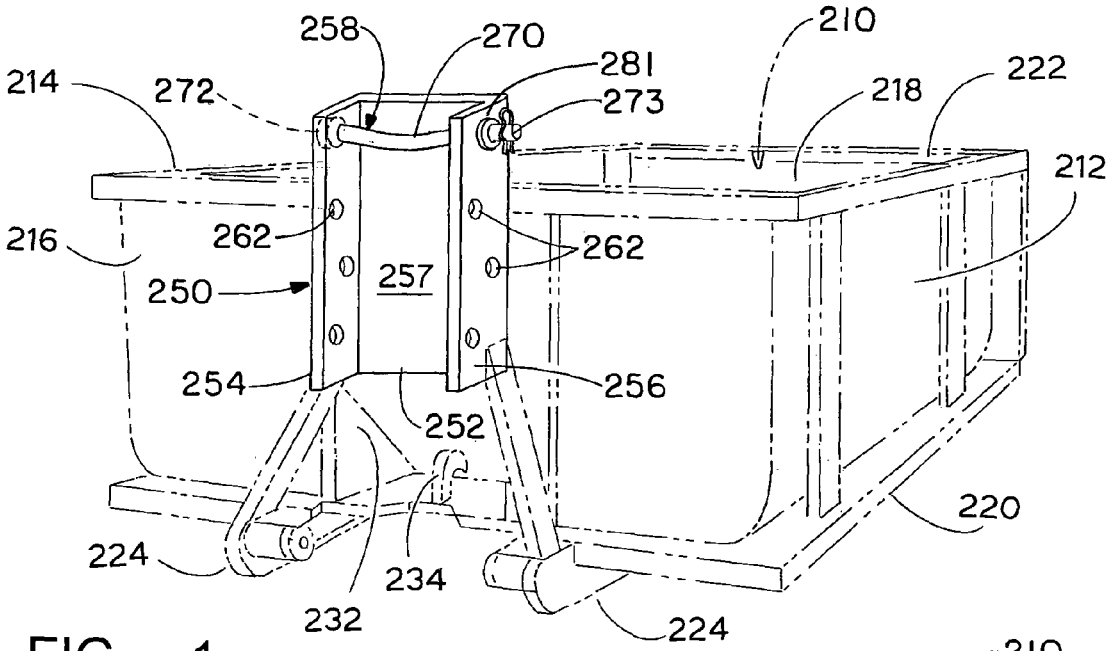
FIG. 1 is a front perspective view of one embodiment of an adjustable attachment apparatus mounted on a container.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to FIG. 1, there is illustrated in perspective view a container 210 including a height adjustable attachment apparatus 250 which permits the container 210 to be manipulated and carried or transported by a truck or other transport means. Container 210 in one embodiment includes side sections or walls 212, 214, a front section, face or wall 216, a rear section, face, or wall 218, and bottom 220. If desired, the container further comprises a top wall or lid 222 as partially shown in FIG. 1. The container walls are arranged to surround or define a filling area or volume, i.e., an empty space or void which is preferably utilized to store various materials or items, including but not limited to, waste materials including residential, commercial and industrial refuse or debris; bulk materials; finished products; parts; or components.

The container 210 is formed from a high strength material such as metal, e.g., steel or other alloy, and generally has a rectangular profile, although other arbitrary shapes, designs and materials are also contemplated. Container 210, optionally including modifications known to the art, in various embodiments and industries, is known as or considered a roll-on, roll-off container, a rear loading dumpster, a compactor receiver box or self-contained unit, recycling container, tank, construction trailer, storage unit, disaster relief trailer, or the like. As shown in FIG. 1, the container includes frame rails 224 connected to bottom 220 which preferably extend substantially the longitudinal length of the container from the front wall 216 to the rear wall 218. The frame rails 224 are preferably parallel and often spaced a predetermined distance apart, such as about 36 to about 48 inches and preferably about 40 to about 46 inches (measured at the outside edge of the rails). In most embodiments, the frame rails 224 serve to guide the container 210 onto a bed of a truck. Often a truck includes frame rollers which engage frame rails 224 and reduce friction as the container is moved in relation to the truck.

In yet other embodiments, container 210 includes doors, windows, or other access orifices such as rear door situated in rear wall 18 which can aid in unloading and/or observing the contents of the container. In a preferred embodiment, container 210 includes rollers or support blocks or pads, or a combination thereof, which contact the ground when the container is not loaded on a truck. Rollers, wheels or the like help to move the container along the ground when moving, loading, or unloading the same. As is known in the art, the container 210 in one embodiment is equipped with a cable receiving hook 234 which as illustrated in FIG. 1, is located in a recess 232, doghouse, or on other alternative container structure which can be used for loading onto a truck or other transport means with an appropriate cable winch system.

Any other container modifications or embodiments as known to those of ordinary skill in the art can be utilized in combination with the present invention, so long as they do not interfere with the operation thereof. In one embodiment, the container is equipped with a locking wing which mates with a corresponding lock, such as a "C" shaped lock located on the truck frame in a loaded position. More than one lock can be provided on a truck or container to accommodate different containers, truck frame lengths, or the like.

A vertically adjustable container attachment apparatus 250 is illustrated in FIG. 1 connected to the front wall 216 of the container. In a further embodiment, one or more adjustable attachment apparatuses 250 are attached to a back or other wall(s) in addition to or in place of the apparatus 250 attached on the front wall 216 of container 210. A portion of the attachment apparatus 250 is preferably welded, bolted or otherwise securely fastened to the front wall 216 of the container 210, or even formed as an integral part thereof.

Figure 2:
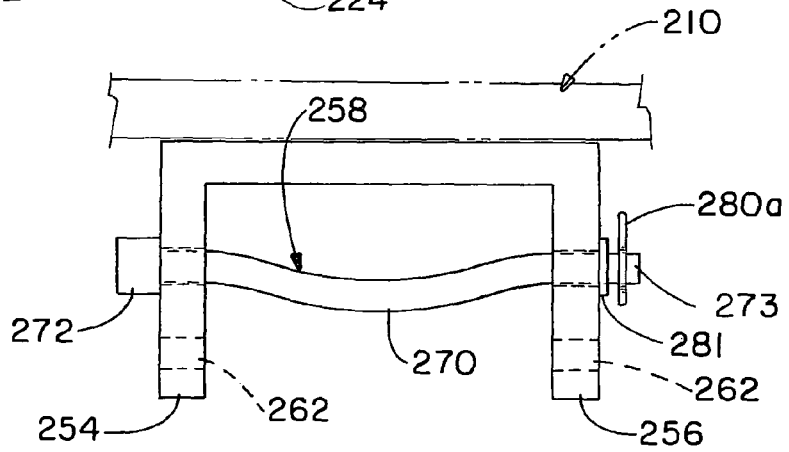
FIG. 2 is a top view of the attachment apparatus and a portion of the container shown in FIG. 1.

In a preferred embodiment such as shown in FIG. 2, attachment apparatus 250 includes a guide member 252 preferably directly connected to wall 216 of container 210. The guide member defines a plurality of vertical positions for the height adjustable connector member 258. Guide member 252 is preferably oriented in a vertical direction, i.e., up and down, along the central portion of the wall 216 as shown in FIG. 1. The guide member 252 extends a predetermined distance or length along wall 216 of the container to provide for the desired location of connector member 258.

The guide rails are connected by back member 257 of the guide member, in some embodiments, which is welded or otherwise fastened to container wall 216.

FIG. 1 illustrates an attachment apparatus 250 connected to a container 210, which permits the container 210 to be manipulated and carried or transported by a truck 40 or other transport vehicle, such as described in U.S. Patent Publication No. 2005/0052042 and U.S. Pat. No. 7,306,273, both fully incorporated herein by reference. As described above, attachment apparatus 250 includes a guide member 252. In one embodiment, guide member 252 extends above a top boundary or edge of a wall of the container 210 to provide for increased vertical height placement of connector member 258. The extended guide member 252 is typically utilized in conjunction with containers having a relatively short vertical height.

As illustrated in FIGS. 1 and 2, guide member 252 comprises guide rails 254 and 256, preferably situated parallel to each other at a predetermined distance generally from about 4 to about 36 inches, desirably from about 6 to about 24 inches, and preferably from about 12 to about 18 inches. The guide member rails 254 and 256 are preferably situated at least at a distance where a portion of the hook or holding element of a jib apparatus of a truck has clearance or otherwise can fit therebetween.

As described hereinabove, the guide member 252 includes a plurality of fastening apertures 262, preferably located on guide rails 254, 256, which are vertically spaced at predetermined locations and intervals, generally at vertical distances from about 1 to about 36 inches, desirably from about 2 to 30 inches, and preferably from about 4 to about 16 inches between two adjacent apertures. The distances between a first aperture and a second aperture and the second aperture and a third aperture, etc. can vary. In a preferred embodiment, two, three or four fastening apertures on located on each guide rail, such as at a height above the ground to allow for connector member crossbar 270 to be situated at a height of about 32 inches, about 36 inches, about 54 inches, or about 62 inches or more above the bottom of a container, which are also compatible with industry preferred truck hook minimum heights. In a preferred embodiment, guide rails 254, 256 include apertures which are co-aligned, i.e. are at the same vertical height and distance from the front wall of the container or the back member of the guide member with respect to each other, as shown in FIG. 1.

Figure 6A:
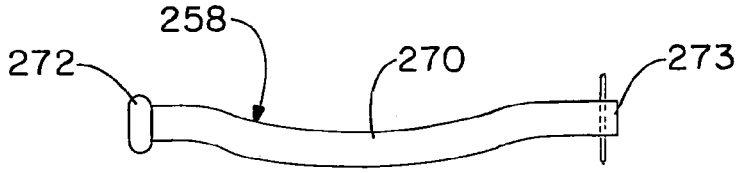
FIGS. 6A, 6B and 6C illustrate various embodiments of connector members of the present invention.
Figure 6B:
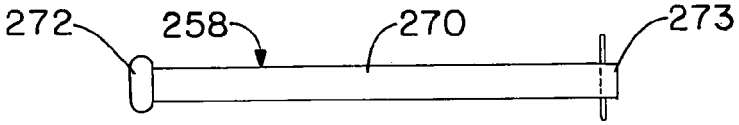
Figure 6C:
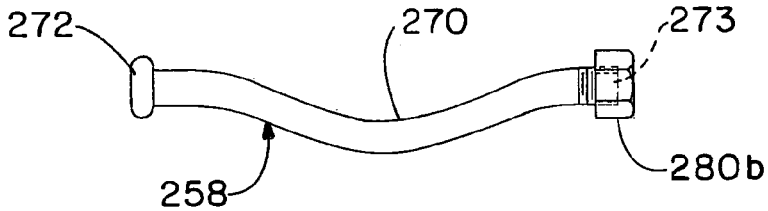

Container attachment apparatus 250 includes connector member 258 which is operatively connected to each guide rail 254, 256, through apertures 262. The connector member 258 includes a crossbar 270 and is adapted to be connected to a hook, implement or other member of a hoist mechanism of a truck or other vehicle which manipulates the container and preferably loads and unloads the same from a truck. Crossbar 270 is generally a linear or curved piece of metal capable of being grasped or attached by the hook or other implement of a truck. The crossbar is situated a desired distance away from back member 257 of the guide member 252 when present and a container wall such as front wall 216 as shown in FIG. 1 in order to provide a desired clearance for a portion of a hook to be extended between the crossbar 270 and the back member 257 and/or wall 216. Apertures 262 are preferably round, but can be oblong, elongated, square, or generally any other shape that facilitates attachment of connector member 258 to guide member 252. Connector member 258 preferably has at least one portion such as crossbar 270 that has a diameter which ranges generally from about 0.75 to 4 inches, desirably from about 1 to 3 inches, and preferably about 2 inches. The diameter along the length of connector member 258 can vary in one embodiment. As illustrated in FIGS. 1 and 2, crossbar 270 is inserted through co-aligned apertures 262 of guide rails 254 and 256 and thus secured and locked in relation to guide member 250, and also container 210, at a desired height above a ground surface. Crossbar 270 of connector member 258 has a cross sectional structure complimentary to aperture 262 that allows the connector member to be inserted through an aperture 262 in each guide rail and fastened to guide member 252. Examples of connector members 258 are illustrated in FIGS. 6A, 6B and 6C. The crossbar 270 of connector member 258 can have any desired shape, such as a curve, arc, angle, linear section, or the like. A general requirement for the shape of connector member 258 is that the same must be able to be removably connected through the aperture of guide rail 252 in one embodiment. As illustrated in FIGS. 6A and 6C, connector member 258 can have a curved or bent mid-portion, or the like to facilitate centering of a hooking element of a transport vehicle in relation to the connector member 258.

Figure 3:
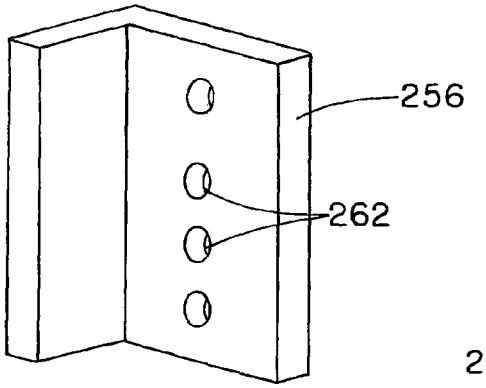
FIG. 3 is a perspective view of one embodiment of a guide member of the adjustable attachment apparatus.

As illustrated in FIGS. 1 and 3, guide member apertures 262 on each guide rail can be arranged in generally any form, such as a straight line, staggered, in an arc, or the like, and preferably are substantially vertical in relation to each other. Crossbar 270 of connector member 258 is disposed a predetermined distance away from container wall and/or guide member back member 257 to provide clearance for attachment of a hook, etc. of a hook truck. In one important aspect of the present invention, such as illustrated in FIGS. 1 and 2, crossbar 270 has a length that extends through each of the guide rails 254 and 256 present on the apparatus 250. In order to attach connector member 258, a first end of crossbar 270 is inserted through an aperture 262 of one guide rail, such as guide rail 254, and then extended through a corresponding aperture and a second guide rail, such as guide rail 256. The crossbar is then fixedly connected to the guide member 252 such as described hereinbelow. In the embodiment illustrated, the portion of crossbar 270 located within apertures 262 of guide rail 252 cannot be substantially displaced towards or away from back member 257 or wall 216. In a preferred embodiment, when the connector member crossbar 270 and apertures 262 are cross-sectionally circular, the diameter of apertures 262 is only slightly larger than the diameter of crossbar 270.

Figure 7:
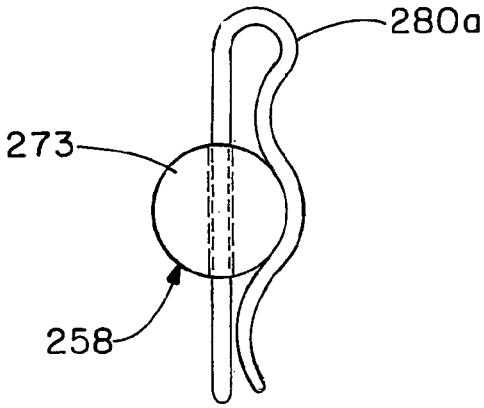
FIG. 7 illustrates one embodiment showing attachment of the securing member to an end portion of a connector member.

In one embodiment, one end portion of connector member 258 includes an end cap or stop 272, preferably permanently attached thereto, that is larger in size than aperture 262 in order to prevent the connector member from being dislodged from guide member 258. Connector member 258 also has a second end portion 273 that can be inserted through guide member 252 apertures 262 after which, a securing element 280 can be attached in order to secure or fix connector member 258 in relation to guide member 252 and between guide rails 254 and 256. In a further embodiment, each end of the crossbar 270 is adapted to be connected to a securing element 280 and either end of the crossbar can be inserted through apertures 262 of a guide member 252 initially. The securing element can be a pin such as a cotter pin, nut, retaining ring, clip, fastener or other element that can be removably connected to the connector member as desired, either interior to or exterior to the guide rail. FIG. 7 illustrates pin 280*a* connected to end 273 of connector member 258. A washer 281 is utilized in conjunction with securing element 280 in some embodiments as illustrated in FIGS. 1 and 2 to aid in preventing connector member 258 from being dislodged from position when connected to guide member 252.

In one embodiment, connector member 258 can be connected to guide member 252 as follows. End 273 of crossbar 270 is inserted in a first aperture 262 in one of guide rails 254 and 256. An end of crossbar 270 of connector member 258 is inserted through the center of guide member 252 and end 273 is inserted through aperture 262 of the other guide rail. After which, securing element 280 is connected to end 273, optionally after a washer 281 is placed on end 273. Thus, connector member 258 is secured to guide member 252 as illustrated in FIGS. 1 and 2, at a predetermined vertical height preferably utilizing one of the co-aligned sets of apertures 262.

One method of utilizing the present invention is as follows. A hoist truck or other transport means is backed up to the container. The hoist arm of the truck, including a hook or other implement capable of retrieving the container, is manipulated to place the hook at the desired height for moving the container. The connector member 258 is then connected to desired apertures of the guide member 252 as described hereinabove at a height which can be operatively connected to the hook or implement of the hoist truck. Once the connector member 258 is secured to the guide member, the hook or other implement is guided underneath the crossbar 270 and operatively connected thereto. The hoist arm is moved upward and towards the truck capturing the crossbar 270 and thus the container which is drawn onto the back of the truck. Additional locking mechanisms as known in the art can be utilized to further secure container 210 to the transportation device.

Figure 4:
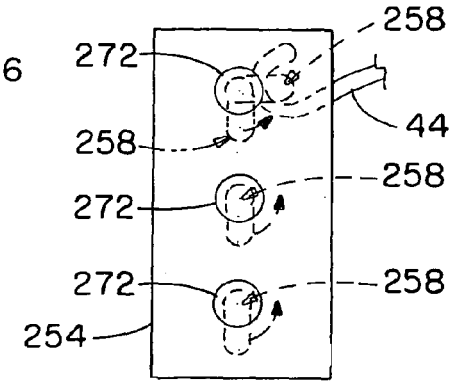
FIG. 4 is a side elevational view of a further embodiment of an adjustable attachment apparatus including a plurality of adjustable connector members.
Figure 5:
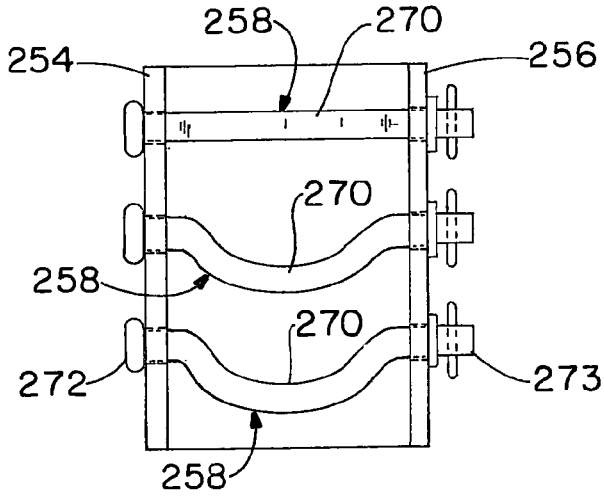
FIG. 5 is a front elevational view of FIG. 4.

In a further embodiment as illustrated in FIGS. 4 and 5, a plurality of connector members 258 are present and operatively connected to guide member 252 between rails 254 and 256 as described hereinabove. In an unused position as illustrated in FIG. 4 for the bottom two connector members 258, the crossbar 270 rests in a position below apertures 262 of guide rails 254 and 256. During use when the connector member crossbar 270 is connected to a hook of a truck, the connector member 258 is rotated to a position relative to horizontal as illustrated in the upper portion of FIGS. 4 and 5.

Figure 8:
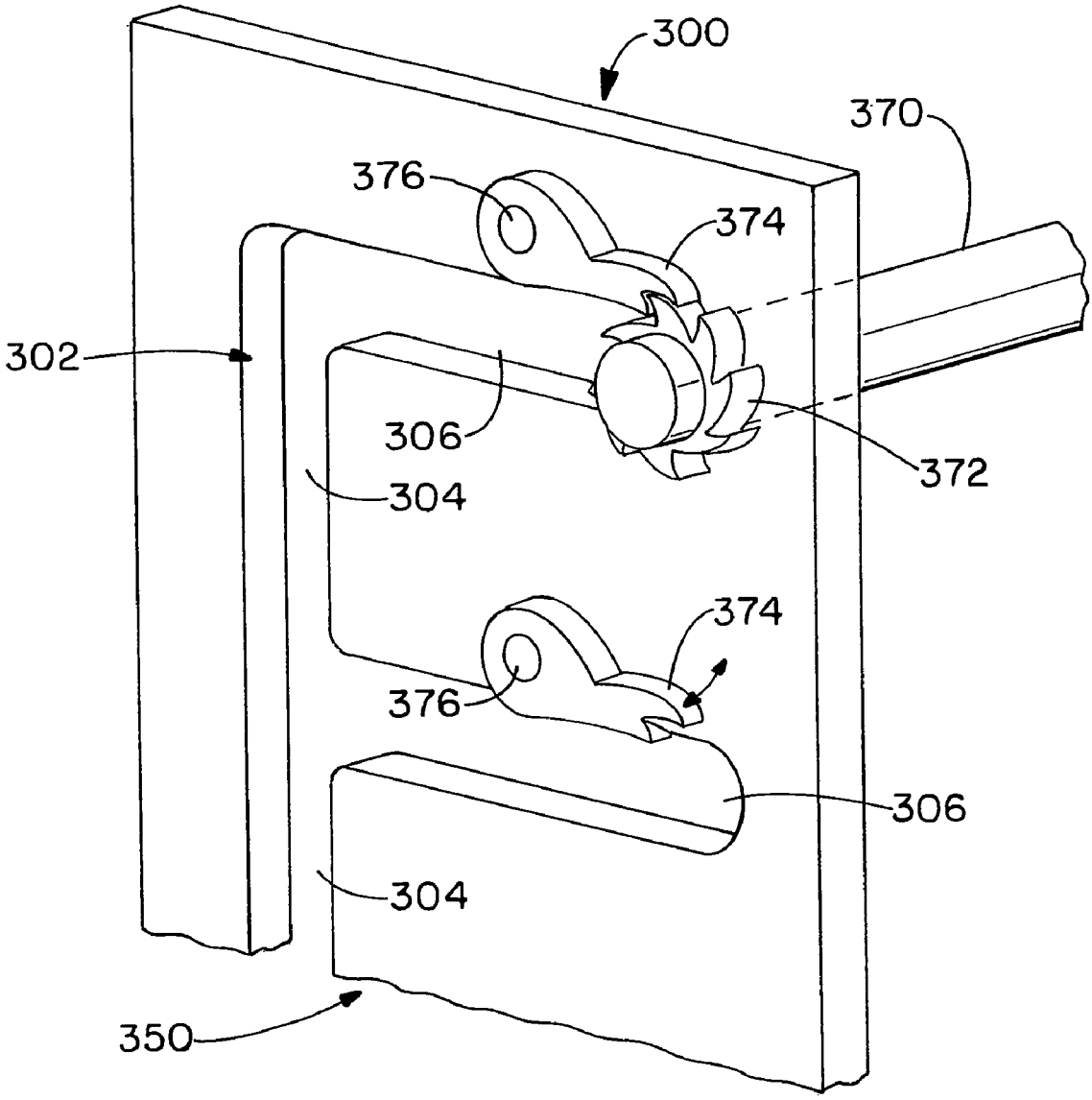
FIG. 8 is a partial front perspective view of an attachment member having a locking mechanism for locking the connector member in relation to the guide member.

A further embodiment of the invention is illustrated in FIG. 8. Attachment apparatus 300 includes a guide member 350 with two or more, preferably two, guide member rails or side members having a slotted track 302 in which a connector member 370 is adjustable in order to place connector member 370 at a desired height for connection to a hook or other element of a transport vehicle in order to transport a container to which attachment apparatus 300 is connected. As described hereinabove and incorporated by reference, a guide rail or guide member 350 is connected to a wall of the container 210 in a desired manner and orientation. Only one guide rail of the guide member is shown in FIG. 8. Slotted track 302 has a width measured transverse to a length of height adjustment slot 304, and a length of an arm slot 306, which is greater than the diameter or width of connector member 370 in order to allow for desired travel within the travel path of slotted track 302.

In one embodiment, the attachment apparatus 300 is formed as follows. A sheet of metal, preferably planar, having a thickness from generally about 0.25 inch to about 3 inches, desirably from about 0.3 inch to about 2 inch, and preferably from about 0.4 to about 1.50 or about 1 inch is utilized. Generally, the structure of the apparatus, i.e., thickness, depends on the container dimensions or weight, end use, etc. The sheet of metal of a predetermined size is folded at the end portions thereof to form the guide rails of a predetermined depth and height. The guide rails are disposed at an angle generally from about 60° to about 120°, desirably from about 80° to about 100°, and preferably about 90° with respect to the remaining non-folded portion of the sheet, i.e., back plate or member 257, and also a container wall when the guide member is attached thereto. In some instances, a back member is not present, and the guide member rails, optionally having an "L" or "T" shaped base, are individually welded to the container. Either before or after the guide rails are formed, the slotted track is formed in a guide rail of the guide member. Examples of slotted track forming methods include, but are not limited to, laser cutting, machining, water cutting, stamping, or the like. After the slotted tracks are formed in the guide rails, a crossbar member is inserted through each guide rail present and end element is preferably connected to each end. Obviously, an end element can be attached to one end of the crossbar member before being inserted through the apparatus guide rails before a second end element is attached to the opposite end.

Track 302 height adjustment slot 304 is preferably aligned in a vertical direction to allow rapid, convenient vertical adjustment of the connector member 370. Height adjustment slot 304 can have alternative shapes or configurations. The high adjustment slot 304 can have alternative shapes or configurations in all or only a portion of the slot length, including but not limited to, a curved portion, an angled portion, or the like, or combinations thereof such as shown in the patents herein incorporated by reference. For example, in one embodiment, the track height adjustment slot 304 is angled in a range from about 1 to about 45 degrees with respect to vertical.

Slotted track 302 includes at least one, and preferably two or more, arm slots 306 open to and extending a predetermined distance from height adjustment slot 304, generally in a forward direction away from a back plate or member of the guide member if present, and container, such as shown in FIGS. 1 and 2. Various configurations and ranges for the number of arm slots 306 are described in U.S. Patent Publication No. 2005/0052042 and U.S. Pat. No. 7,306,273. In one embodiment, the transition between the height adjustment slot and the arm slot is relatively smooth, such as a curve or arc, and not abrupt such as a 90° angle. The arm slot has an end portion located away from the container 210 and/or back member 257 that is adapted to house the crossbar 370 at a predetermined height above a ground surface, where a portion of the hook truck jib apparatus such as a hook or other implement can operatively be attached to the connector member 370 of the apparatus 300 and thus move the container.

The arm slot 306 can have a portion thereof which is located or disposed at an angle of about 1° to about 60° with respect to horizontal. Substantially horizontal arm slots are illustrated in FIG. 7 and the slotted track 302 can be considered as having a comb configuration. A number of arm slots per guide member rail ranges from 1 to about 12 or about 25, desirably from 1 to about 6, and preferably from about 1 to about 4. The arm slot configuration maintains the crossbar 370 at a predetermined horizontal distance away from a container wall or back member 257, such as about 2 to about 12, and preferably from about 5 to about 7 inches so that a hook or other implement has enough clearance to be operatively attached to the attachment apparatus 300 as described herein.

Crossbar 370 is a connector member which includes portions that extend through the slotted tracks in any of the guide member rails present such as described hereinabove for crossbar member 370. In a preferred embodiment, the cross member is a tubular, cylindrical bar, and most preferably a solid metal bar formed from about one to about three inch round stock, with two inch round stock being highly preferred.

At least one arm slot 306 is provided with a locking mechanism, preferably located at the closed end of the arm slot 306 away from the open end connected to height adjustment slot 304. The locking mechanism locks crossbar 370 in a predetermined position with respect to guide member 350. In a preferred embodiment, each arm slot of each rail includes a locking mechanism. The connector member 370 can be unlocked, moved to a second position and locked into position with a second locking mechanism.

The locking mechanism includes a first portion connected to the guide rail positioned adjacent an arm slot 306, preferably near the outer terminal end of arm slot 306 located away from height adjustment slot 304. The locking mechanism contains a second portion that, in a locking position, interacts with and is mateable to the first portion of the locking mechanism connected to the guide rail. The mated connection between the locking mechanism first portion and second portion prevents lateral movement of the crossbar 370 in arm slot 306 towards the height adjustment slot 304. In a preferred embodiment, the first portion and second portion include complementary fittings such as male and female connections that lock the connector member in the arm slot in a desired position.

As indicated hereinabove, preferably each arm slot present includes a locking mechanism where the locking mechanism can be located on either side of the guide rail such as exterior to the apparatus or located within or between a pair of guide rails. In order to remove the crossbar 370 from the locked position, the locking mechanism is deactivated such as by releasing the connection between the first portion and second portion.

In one embodiment, the locking mechanism includes a pawl 374 that is connected to a guide rail via a fitting 376 as illustrated in FIG. 8. Pawl 374 is rotatable in relation to fitting 376 and biased towards the position shown in FIG. 8, i.e. towards a portion of the arm slot 306. The locking mechanism further includes a ratchet or cog 372 that is connected to connector member 370 and mateable with pawl 374 in a locking position. Ratchet 372 includes a plurality of teeth that engage corresponding teeth on pawl 374 and lock connector member in a fixed position until pawl 374 is released and connection member 370 can be moved. In a preferred embodiment, connector member 370 includes a ratchet 372 on each end portion thereof. In a preferred embodiment, pawl 374 is biased towards arm slot 306 such as with a spring or other mechanism operatively connected to pawl 374. Likewise, it is desirable that each guide rail include a pawl operatively connected thereto so that both sides of the connector member can be locked in relation to guide member 350.

The locking mechanism can be utilized as follows. Connector member 370 is moved along height adjustment slot 304 to an arm slot 306 at a desired height. The connector member 370 is moved forward toward the end of arm slot 306 away from height adjustment slot 304. As connector member 370 moves forward towards the front end of arm slot 306, pawl 374 engages with ratchet 372 such as illustrated in FIG. 8. With the teeth of pawl 374 and ratchet 372 engaged, connector member 370 is secured in relation to guide member 350 and thus a container attached thereto. Connector member 370 can then be connected to a hook or other element of the desired transport vehicle in order to transport the attachment apparatus 300 and thus a container. The locked connection between connector member 370 and guide member 350 is undone by adjusting the ends of pawls 374 upwards so that the teeth thereof disengage from the teeth of the respective ratchets 372 connected thereto whereby the connector member 370 can be moved to another desired position. The hook or other implement of a hook truck is attached to the crossbar 370 after the same has been placed in the desired position so that the container can be transported, such as described herein.

With the present invention container including the multiple height adjustable container attachment apparatus, crossbar element height can be modified to allow a container to be picked up by many different sizes and/or types of trucks or other transport vehicles. In a preferred embodiment, the height adjustable container attachment apparatus is adjustable and has a crossbar or hook receiving support element height of generally about 12 to about 84 inches, desirably about 24 to about 72 inches and preferably from about 28 to about 70 inches. In a further embodiment, the crossbar 70, 170 is fixedly adjustable at heights of about 32 inches, about 36 inches, about 54 inches, and about 62 inches. In yet a further embodiment, the height adjustable container attachment apparatus is adjustable to have crossbar heights which vary incrementally by about ½ or about 1 inch to about 12 inches, and desirably from about 4 to about 8 inches. One aperture can have different spacings between adjacent apertures; i.e. uneven spacing.

The attachment apparatus 250 of the present invention has guide rails, such as 264, 266 or guide member 350 as illustrated in FIG. 8 which is shown as a guide rail, that are each disposed at an angle with respect to vertical and to another guide rail present on the attachment apparatus 250, 300 and container 210. In various embodiments, each guide rail can be oriented at an angle with respect to vertical generally from about 0 to about 60 degrees, desirably from 0 to about 45 degrees, and preferably from 0 to about 20 degrees. Angled guide rails are utilized in situations where it is impractical or not desired to utilize substantially parallel rails attached to a container or a back member that is attached to the container. Parallel, vertically oriented rails are preferred.

In accordance with the patent statutes, the best mode and preferred embodiment have been set forth; the scope of the invention is not limited thereto, but rather by the scope of the attached claims.

What is claimed is:

1. An attachment apparatus for a container that is adapted to be used to transport the container, comprising:

a stationary guide member having at least two guide rails spaced a distance from each other, wherein the guide member is adapted to be connected to a wall of the container by one or more of a back member separate and distinct from the container wall and a rear edge of each of the at least two guide rails, each guide rail having therein at least two apertures located at different fixed vertical heights and capable of receiving a crossbar of a connector member, wherein the first aperture of the first guide rail is substantially vertically and horizontally co-aligned with the first aperture of the second guide rail, wherein the second aperture of the first guide rail is substantially vertically and horizontally co-aligned with the second aperture of the second guide rail; and the connector member crossbar extending completely through one set of the co-aligned apertures of the first guide rail and the second guide rail, and wherein the crossbar extends between the guide rails and is adapted to be engaged by a hook or attachment element of a container retrieving hoist mechanism of a transport vehicle so that the attachment apparatus can be moved, wherein the connector member is fixedly connectable to the guide member by a securing mechanism connected to the connector member through one or more of a connection to the connector member (a) outside the guide rails and (b) in between the guide rails.

2. The attachment apparatus according to claim 1, wherein the connector member includes a first end having a stop and a second end having a securing element removably connected thereto, wherein two to about eight pairs of co-aligned apertures are present on the first and second guide rails.

3. The attachment apparatus according to claim 1, wherein with respect to a longitudinal direction, the guide rails are substantially parallel or are each disposed at an angle of about 1° to about 45° with respect to vertical with upper ends of the guide rails being closer together than the lower ends of the guide rails, and wherein each guide rail has a thickness of from about 0.25 to about 3 inches.

4. The attachment apparatus according to claim 1, wherein each guide rail has a front edge which is spaced an average distance of about 4 to about 36 inches with respect to at least one other guide rail, and wherein one pair of the co-aligned apertures is spaced a different distance from a rear end of the guide member adapted to be connected to the container when compared to the second set of co-aligned apertures.

5. The attachment apparatus according to claim 4, wherein the guide rail thickness is about 0.3 to about 2 inches, wherein the guide rails are connected to a back plate, and wherein the connector member includes a first end having a stop and a second end having a securing element removably connected thereto.

6. The attachment apparatus according to claim 5, wherein the guide rails are substantially parallel to each other.

7. The attachment apparatus according to claim 1, wherein the guide rails are substantially parallel to each other, and wherein the guide rails are connected to a back plate with the back plate connected to an upright section of the container.

8. The attachment apparatus according to claim 7, wherein the angle between the back plate and each rail is about 60° to about 120°, wherein the connector member includes a central portion having a bend adapted to guide the hook or attachment element towards the central portion of the connector member.

9. The attachment apparatus according to claim 1, wherein two adjacent apertures on one of the guide rails are spaced at a distance of from about 4 to about 16 inches, wherein two to about four apertures are present on each guide rail, and wherein the connector member includes a first end having a stop and a second end having a securing element removably connected thereto.

10. The attachment apparatus according to claim 1, wherein the connector member includes an aperture through which the securing element extends in order to fixedly connect the connector member to the guide member, and wherein the securing element is a pin or fastener that extends transversely through the connector member.

11. The attachment apparatus according to claim 1, wherein a plurality of connector members are each connected to a set of co-aligned apertures in the first and second rail with the connector members situated at different vertical heights.

* * * * *